United States Patent [19]

Hidding

[11] Patent Number: 4,942,977

[45] Date of Patent: Jul. 24, 1990

[54] BREAKAWAY TAMPER EVIDENT COVER

[76] Inventor: Daniel P. Hidding, Rte. 2, Ridgecroft La., Barrington Hills, Ill. 60010

[21] Appl. No.: 281,466

[22] Filed: Dec. 8, 1988

[51] Int. Cl.[5] ..... B65D 17/40

[52] U.S. Cl. ..... 220/276; 220/270; 220/85 P; 222/153; 222/182

[58] Field of Search ..... 220/270, 276, 85 P; 215/254, 255, 256; 222/153, 182

[56] References Cited

U.S. PATENT DOCUMENTS

| | | | |
|---|---|---|---|
| 3,028,992 | 4/1962 | Bucher et al. | 220/270 |
| 3,037,672 | 6/1962 | Gach | 220/85 P |
| 3,081,899 | 3/1963 | Parker | 220/276 |
| 3,102,658 | 9/1963 | Rosen | 220/270 |
| 3,170,603 | 2/1965 | Kitterman | 215/256 X |
| 4,305,517 | 12/1981 | Dennis | 215/256 |
| 4,744,483 | 5/1988 | Hidding | 220/270 |
| 4,821,913 | 4/1989 | Hidding | 220/270 |

*Primary Examiner*—Stephen Marcus
*Assistant Examiner*—Nova Stucker
*Attorney, Agent, or Firm*—Thomas E. Smith

[57] ABSTRACT

A breakaway tamper evident cover for a container such as a spray can is provided with a cap portion and a locking ring portion, the two portions being connected by a frangible tear line. The frangible tear line is ruptured by striking a sharp axial blow to the top of the cap, driving the cap downward into the closure of the container and away from the locking ring. The rim of the cap is provided with an outwardly extending flange which snaps under the interior portion of the container's closure bead to secure the cap to the container while the locking ring remains in place.

6 Claims, 2 Drawing Sheets

BREAKAWAY TAMPER EVIDENT COVER

BACKGROUND OF THE INVENTION

This invention relates to a cover for a container such as an aerosol container for preventing dust and other contaminants from contacting the dispensing mechanisms and possibly the contents of the container. More particularly, the invention relates to a tamper evidencing cover which may be initially removed only by breaking a seal to evidence the fact of such a removal.

Tamper evident covers for containers are well known. Previous tamper evident covers have been described, for example, in the following U.S. Pat. Nos. 4,565,294 to Smith; 4,322,010 to Curry; 4,476,993 to Krout; and 4,307,821 to McIntosh. The prior art devices have incorporated tear strips which are peeled away from the cap by pulling on a gripping member. The problem with such a design is that it is often difficult to initiate the tearing of the tear strip and it is also difficult to complete the tearing away of the tear strip. The gripping members are of a size that they can only be grasped between a thumb and a finger, making it difficult to generate a sufficient clamping force on the gripping member to facilitate the removal of the tear strip. This is especially difficult for people with arthritis in their hands.

The present invention provides a tamper evident cover that does not require the use of tear strips. The cover is inexpensive to produce, and provides a tight seal with the container. The cap may be easily separated from the locking ring by striking a sharp axial blow downwardly on the top portion of the cap, rupturing the frangible tear line and driving the cap downward into the closure of the container. Once the cap and locking ring are separated, the cap may be snapped into the closure portion of the container without removing the locking ring.

SUMMARY OF THE INVENTION

The present invention is used with a container having a closure with a surrounding outwardly extending closure bead and a nozzle which extends upwardly through the closure for discharging the contents of the container. The hollow cap of this invention covers and accommodates therewithin the discharge nozzle. The cap has a generally circular top portion with a generally cylindrical sidewall extending downwardly from the edge of the top portion, forming a generally circular rim, equally spaced from the top portion of the cap. A flange extends outwardly from the rim and is connected to a locking ring by a frangible tear line. The locking ring is adapted to surround the container's closure bead and has an inwardly extending locking flange for extending under and engaging the closure bead, thereby locking the locking ring onto the container. A slot is provided in the locking ring abutting the outwardly extending flange to facilitate the initial rupturing of the frangible tear line.

The frangible tear line may be ruptured by striking a sharp axial blow to the top portion of the cap, driving the cap downwardly into the closure of the container. This initial rupture along the frangible tear line is evident upon even casual inspection of the cover. After the cap has been separated from the locking ring, there remains an outwardly extending flange on the rim of the cap's sidewall, which is adapted to snap beneath the closure bead in the interior portion of the closure enabling the cap to be removed and securely replaced on the container without removing the locking ring.

DETAILED DESCRIPTION OF THE PREFERRED EMBODIMENTS OF THE INVENTION

Figure 1:
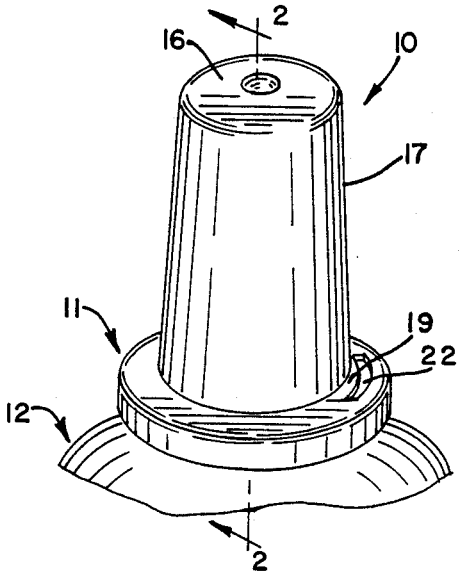
FIG. 1 is a perspective view of the first embodiment of a tamper evident cap constructed in accordance with this invention, shown on a container.
Figure 2:
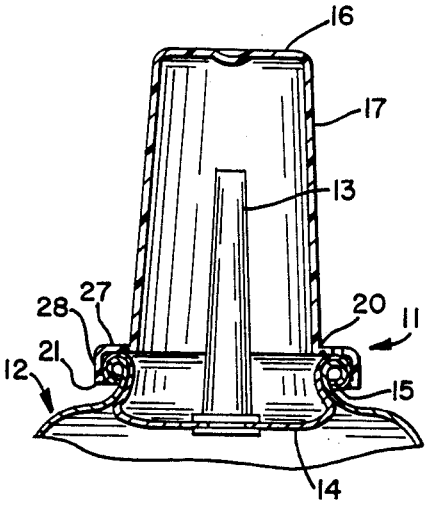
FIG. 2 is a cross-sectional view taken along lines 2—2 of FIG. 1.

The breakaway tamper evident cover is shown in FIG. 1 as being applied to a container 12 such as an aerosol can having a closure 14 with an outwardly extending closure bead 15. The nozzle or other product dispensing structure 13 extends upwardly through the closure and permits discharging of the contents of the can therethrough.

The dislosed cover, as shown in FIGS. 1–5, has a hollow cap 10 for covering and accommodating therewithin the nozzle 13. The cap has a generally circular top portion 16, and a generally cylindrical tapered sidewall portion 17 extending downwardly from the top portion, forming a generally circular rim 18 equally spaced from the top portion 16. A flange 19 extends outwardly from the rim 18. The outwardly extending flange 19 is adapted to engage the inner portion of the closure 14 beneath the closure bead 15 to secure the cap 10 to the container 12 once the cap 10 has been separated from the locking ring 11.

The locking ring 11 is attached to the outwardly extending flange 19 of the cap by a frangible tear line 20. The locking ring 11 is adapted to surround the closure bead 15. The locking ring is circular having an L-shaped cross section with a horizontal leg 27 connected at one end to the frangible tear line 20 and connected at the other end to a downwardly extending vertical leg 28. At the free end of the vertical leg 28, a locking flange 21 extends inwardly to extend under and engage the underside of the closure bead 15. The horizontal leg 27 has an open slotted portion 22 that is peripherally adjacent to the flange 19 which facilitates the initial rupturing of the frangible tear line 20. The locking flange 21 is interrupted in the area of the slotted portion 22.

The frangible tear line 20 constitutes a relatively weak portion between the flange 19 and the locking ring 11. The frangible tear line 20 is formed by moulding a thin wall section at the position of the frangible tear line 20, the thickness of this section being considerably less than that of the flange 19 or the locking ring 11. The frangible tear line 20 starts at one end of the slotted portion 22 and runs peripherally adjacent to the flange 19 and terminates at the opposite end of the slotted portion 22, substantially encircling the flange 19.

The cap and the locking ring 11 are initially forced onto the closure bead 15 of the container, and the inwardly extending locking flange 21 is snapped in place beneath the outwardly extending closure bead 15. Access to the nozzle 13 or the closure 14 by pulling on the cap 10 cannot be had without visibly tearing the frangible tear line 20. Such tearing provides a clear indication of tampering.

Figure 3:
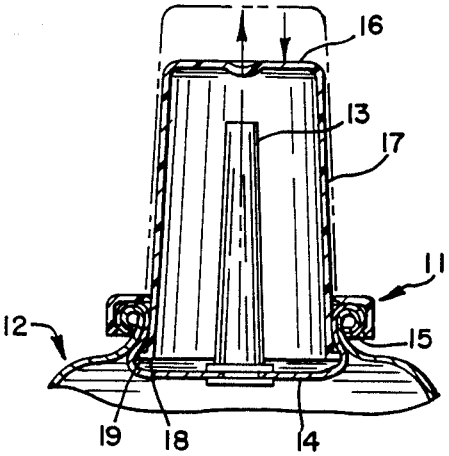
FIG. 3 is a cross-sectional view of the cap in its snapped-on position after the frangible tear lines have been ruptured and the cap separated from the locking ring.
Figure 4:
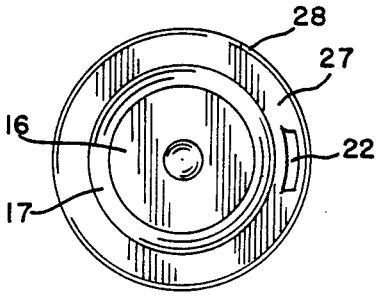
FIG. 4 is a top plan view of the first embodiment of the cap of this invention.
Figure 5:
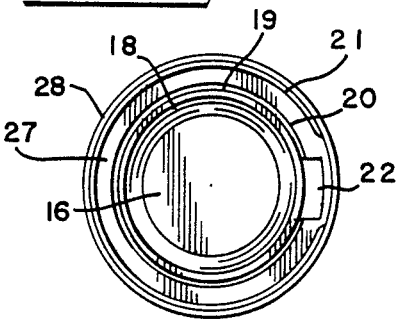
FIG. 5 is a bottom plan view of the first embodiment of the cap of this invention.
Figure 6:
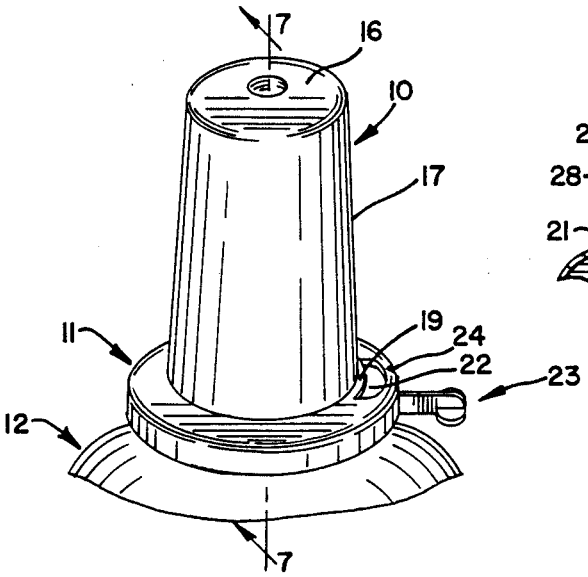
FIG. 6 is a perspective view of the second embodiment of a tamper evident cap constructed in accordance with this invention, shown on a container.
Figure 7:
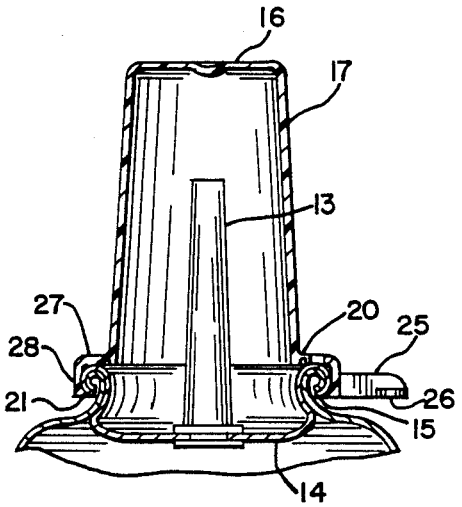
FIG. 7 is a cross-sectional view taken along line 7—7 of FIG. 6.

When the purchaser receives a container with the cap in place, the cap 10 may be easily removed from the locking ring 11 by rupturing the frangible tear line 20. The frangible tear line 20 may be ruptured by striking a sharp axial blow to the top portion 16 of the cap. Such a blow may be created by various means such as with the heel of the hand or by inverting the container 12 and striking the top portion 16 of the cap on a hard surface such as a table or countertop. When the frangible tear line is severed in such a manner, the cap 10 will be forced downwardly into the closure 14 of the container as shown in FIG. 3. The cap 10 may then be removed from the container 12 while the locking ring 11 remains attached. The cap 10 may thereafter be securely snapped onto the container 12, while the locking ring 11 remains attached to the container, by pushing the rim 18 of the cap into the interior portion of the closure 14 until the outwardly extending flange 19 will engage the interior portion of the closure 14 below the bead 15 as shown in FIG. 3.

A second embodiment of the breakaway tamper evident cover, shown in FIGS. 6–10, enables the removal of the locking ring 11. In this embodiment, the locking ring 11 is provided with a grip member 23 extending radially outwardly from the vertical leg 28. The grip member 23 has a leg portion 25 and a tip portion 26. The leg portion 25 extends radially outwardly from the locking ring 11. The tip portion 26 of the grip member 23 is substantially flat and extends transversely from the leg portion 25. A frangible notch line 24 extends through the locking ring 11 adjacent to and preferably near one end of the slotted portion 22. The inwardly extending locking flange 21 is interrupted in the area of the slotted portion 22 and the notch line 24. The grip member 23 is placed closely adjacent to the frangible notch line 24.

Figure 8:
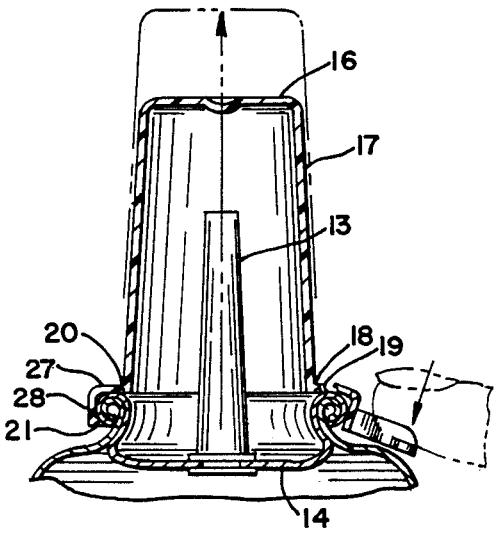
FIG. 8 is a cross-sectional view of the second embodiment showing a force being applied to the grip member to remove the locking ring.
Figure 9:
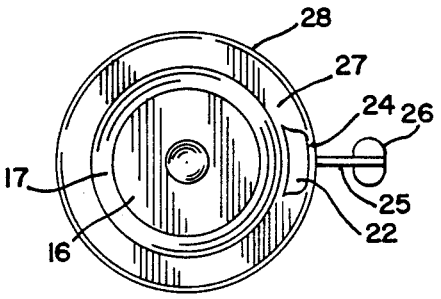
FIG. 9 is a top plan view of the second embodiment of this invention.
Figure 10:
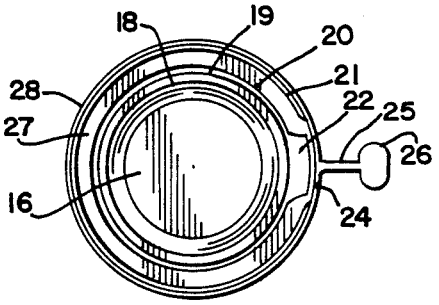
FIG. 10 is a bottom plan view of the second embodiment of this invention.

In the second embodiment, there are two methods available for severing the cap 10 from the locking ring 11. The first and preferred method is the same as in the first embodiment. The tear line is ruptured by striking a sharp axial blow to the top portion 16 of the cap 10, driving the cap downwardly into the closure 14. A downward force may then be applied to the tip portion 26 of the grip member 23 as shown in FIG. 8. This downward force creates a twist in the locking ring, causing the notch line 24 to tear. Once the notch line 24 is torn, the locking ring 11 may be easily removed from the container.

The second method for severing the cap 10 from the locking ring 11 is to first tear the notch line 24 by pushing the grip member 23 downwardly as shown in FIG. 8. The grip member 23 may then be pulled outwardly, severing the frangible tear line 20 and peeling the locking ring 11 away from the container 12 and the cap 10. Once the locking ring 11 has been removed, the cap 10 may be snapped securely onto the container 12 by pushing the rim 18 of the cap down into the closure 14, until the outwardly extending flange 19 will engage the closure 14 beneath the interior of the bend 15.

The foregoing description has been given only by way of example, and it will be apparent to those skilled in the art that modifications may be made in the disclosed structure without departing from the scope and true spirit of the invention as hereinafter claimed.

What is claimed is:

1. A tamper evident cover for use with a container having a closure with a surrounding outwardly extending closure bead and a closure inner portion formed under the inside of the closure bead, and a nozzle extending upwardly through the closure for discharging the contents of the container therethrough, said cover comprising:

a generally circular top portion;

a generally cylindrical sidewall extending downwardly from the edge of said top portion forming a generally circular rim equally spaced from said top portion;

a flat, substantially continuous and horizontal flange extending outwardly from said rim over said closure bead;

a locking ring adapted to surround the outwardly extending closure bed, having an inwardly extending locking flange for engaging under the outside of the closure bead to secure the locking ring to the container;

a frangible tear line overlying said closure bead and connecting said locking ring to said outwardly extending flange whereby after said frangible tear line has been ruptured, said cover sidewall and said outwardly extending flange may be forced downwardly into the closure beneath said closure bead and said outwardly extending flange will spring outwardly to engage said closure inner portion under said closure bead to removably retain said cover in position.

2. The structure of claim 1 wherein said sidewall is tapered from said rim to said top portion.

3. The structure of claim 1 wherein said locking ring has at least one open slotted portion running peripherally adjacent to the outwardly extending flange.

4. The structure of claim 3 wherein said inwardly extending locking ring flange is interrupted in the area of said slotted portion.

5. The structure of claim 4 wherein said locking ring additionally comprises:

a frangible notch line extending from said slotted portion through said locking ring; and an integral grip member adjacent to said frangible notch line whereby said locking ring may be removed from the container.

6. The structure of claim 5 wherein said grip member comprises:

a leg portion extending radially and outwardly from said locking ring; and a substantially flat tip portion integral with and extending transversely to said leg portion.

* * * * *